United States Patent [19]

Barnhart et al.

[11] 4,073,597

[45] Feb. 14, 1978

[54] FAN HOUSING ASSEMBLY

[75] Inventors: David A. Barnhart, Cincinnati; Gordy E. Loftin, Middletown, both of Ohio

[73] Assignee: The Celotex Corporation, Tampa, Fla.

[21] Appl. No.: 763,290

[22] Filed: Jan. 28, 1977

[51] Int. Cl.[2] ..... F04D 29/62; F24F 13/08

[52] U.S. Cl. ..... 415/201; 415/206; 415/219 C; 98/114

[58] Field of Search ..... 415/201, 219 R, 219 C, 415/206, 203; 98/114, 33 R, 33 A, 39, 121 R, 108; 417/423 R; 220/4 R, 4 F, 340

[56] References Cited

U.S. PATENT DOCUMENTS

| | | | |
|---|---|---|---|
| 1,815,346 | 7/1931 | Covell | 98/114 |
| 2,005,408 | 6/1935 | Allin | 415/219 C |
| 2,015,210 | 9/1935 | Witzel | 415/201 X |
| 2,710,717 | 6/1955 | Palmer | 98/121 R X |
| 3,561,906 | 2/1971 | Fermer | 415/219 C UX |
| 3,725,640 | 4/1973 | Kunz | 415/219 R X |
| 3,930,818 | 1/1976 | McDougall | 415/219 C X |
| 3,960,527 | 6/1976 | Goettl | 415/219 C X |

FOREIGN PATENT DOCUMENTS

| | | | |
|---|---|---|---|
| 1,251,021 | 12/1960 | France | 98/114 |

*Primary Examiner*—Carlton R. Croyle
*Assistant Examiner*—Donald S. Holland
*Attorney, Agent, or Firm*—James W. Grace

[57] ABSTRACT

A fan housing assembly for an exhaust fan is provided with an orifice pan which can be securely but removably snapped in place to close an open face of the fan housing and provide a means of supporting a ventilating grille.

4 Claims, 5 Drawing Figures

FAN HOUSING ASSEMBLY

BACKGROUND OF THE INVENTION

1. Field of the Invention

A novel fan housing assembly finds most utility in the field of exhaust fans which are enclosed in a metal or plastic box with an outlet valve and a grille covering the air intake face of the box.

Small exhaust fan assemblies such as those used in kitchen range hoods for the exhaustion of fumes and odors resulting from cooking and baking, are usually inexpensively made. The entire assembly, including the fan and housing, must be simple to make and easy to install. In addition, because the fan may be replaced from time to time, it is necessary to provide for easy disassembly of a portion of the fan housing to permit access to the fan for ready attention or service. Also, since in many instances, the cooking fumes contain grease vapors, the fan and the interior of the assembly must be easily accessible for cleaning. All of these features must be available in a relatively inexpensive device.

Because of the nature of the exhaust fan assembly, it must be manufactured with as few intricate steps as possible out of simple, commonly available sheet metal. The parts must be easily stamped and formed. A minimum number of parts must be utilized so that the installation and accessability of the assembly is as simple as possible.

While the fan housing assembly is most commonly made of metal, it may also be made of suitable plastic material, if desired.

SUMMARY OF THE INVENTION

This invention is directed to an exhaust fan housing assembly which is simple to manufacture, easy to install and whose interior is readily accessible for cleaning and maintenance. A box is provided with a baffle and exhaust valve for directing the air through the fan assembly and exhausting the air to the outside of the housing. A simple orifice pan which is held tightly in place by a combination of slots and fingers along one edge and a series of paired detents along the opposite edge with a friction fit is provided as an essential part of the fan housing assembly.

It is a primary object of the present invention to provide a novel fan housing assembly which is simple to manufacture and easy to assemble.

It is another object of the present invention to provide a novel fan housing assembly which provides easy access to the interior of the fan housing assembly for cleaning and service.

DESCRIPTION OF THE PREFERRED EMBODIMENT

Figure 1:
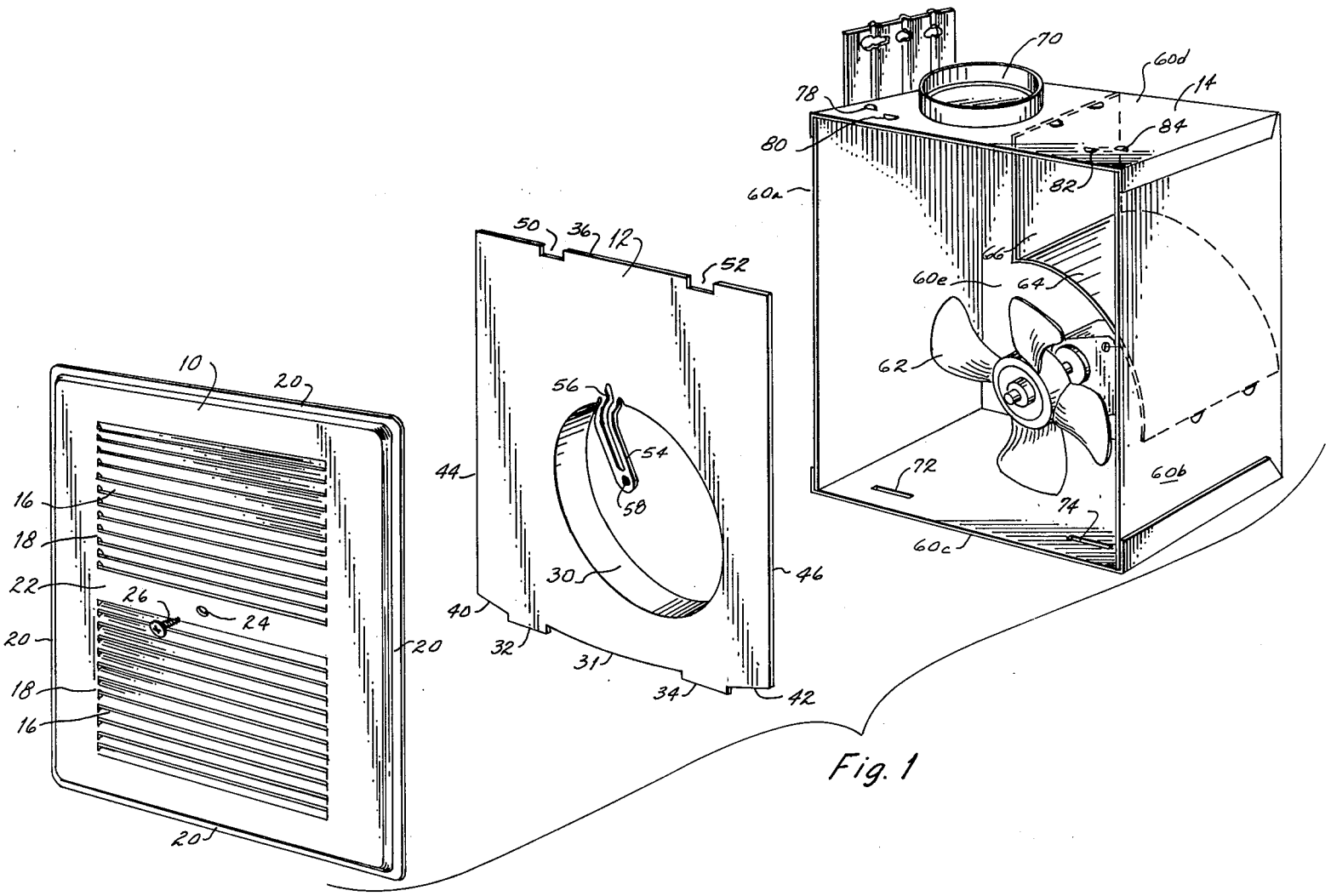
FIG. 1 is a perspective view of the fan housing assembly of the invention with certain parts separated from others.

Referring now to FIG. 1 there is shown from left to right a ventilating grille 10, an orifice pan 12 and a fan housing box 14. Ventilating grille 10 comprises a light gauge aluminum or plastic cover with louvered slots 16 in its front face and an outer peripheral rim 20 along its outer edge. The peripheral rim 20 has a dimension such that it fits against the ceiling or wall area surrounding the opening in which the fan housing box 14 may be mounted. Louvers 16 formed in two separate areas 18 permit air to flow into the interior of fan housing box 14 from the room in which the fan housing assembly is located. A narrow unlouvered area 22 is left between the two areas 18. A small screw hole 24 is provided in the center of unlouvered area 22 to permit a small metal screw 26 to enter to hold grille 10 against the ceiling or wall area surrounding the opening in which the box 14 may be mounted. Intermediate grille 10 and fan housing box 14 is orifice pan 12 which serves to provide a support for ventilating grille 10.

Orifice pan 12 may be stamped out of thin sheet metal (approximately 0.034 in. galvanized) with an offset circular opening 30 of about 4¾ inches in diameter. Along the lower edge 31 of pan 12 are two outwardly extending projections or fingers 32 and 34 which are spaced from each other on opposite sides of the vertical centerline of pan 12. It should be noted that the lower edge 31 of pan 12 between fingers 32 and 34 and the two shorter edges 40 and 42 from the outer edges of fingers 32 and 34 to the outer sides 44 and 46 of pan 12 are formed as an arc of a circle such that the center of edge 31 of pan 12 is lower than the shorter edges 40 and 42.

Along the upper edge 36 there are formed two notches 50 and 52 which form entry areas for screw drivers or other tools to facilitate the engagement and disengagement of orifice pan 12 with the detents of housing box 14. An intergral member 54 is formed by punching out a strip from the metal forming orifice pan 12. Strip 54 is integral with the surface of orifice pan 12 but is offset forwardly a slight amount and is elongated to form an arm extending over the opening 30. A strengthening rib 56 is formed in member 54 to provide rigidity. An internally threaded hole 58 is provided in the outer face of member 54 to receive screw 26 to afix grille 10 in place.

Fan housing box 14 comprises a generally rectangular metal box with sides **60*a*, 60*b*, a bottom wall 60*c*, a top wall 60*d*, a back wall 60*e*, and an open side. Box 14** may be made of sheet metal of .031 gauge thickness. Known cutting and forming techniques may be used to form this box and so no discussion of how it is to be made will be attempted herein.

A fan 62 is mounted inside box 14 and is located so as to be concentric with opening 30 of orifice pan 12. When fan 62 is operating, it draws air through grille 10 through opening 30 of orifice pan 12 into fan housing box 14 and out through a valve outlet 70.

Inside fan housing box 14 is an arcuate baffle 64 which may be secured to side **60*b*, top wall 60*d* and back 60*e* by spot welding or other means. An upright section 66 of baffle 64 connects the arcuate portion of baffle 64 to the top wall 60*d* of fan housing box 14. The arcuate side of baffle 64 forms a chamber which directs the air driven by fan 62 out of box 14 through valve outlet 70**.

Bottom wall 60c of fan housing box 14 has two slots 72 and 74 cut therein. Slots 72 and 74 are located so as to receive outwardly extending fingers 32 and 34 of orifice pan 12.

Top wall 60d of fan housing box 14 has a series of detents 78, 80, 82 and 84 which are punched or formed into the top wall 60d to form a series of holding units for orifice pan 12 when it is inserted in the fan housing box 14. As will become clearer hereinafter, detents 78 and 80 act as a pair to form one holding unit and detents 82 and 84 act as a second holding unit.

Figure 4:
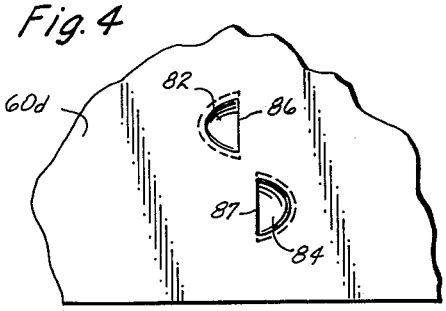
FIG. 4 is a top view of a portion of the fan assembly box of FIG. 2.
Figure 3A:
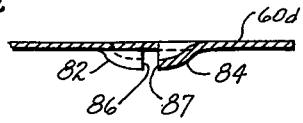
FIG. 3A is a cross-sectional view of a portion of the fan assembly box taken along lines 3—3 of FIG. 2 without the orifice pan in place.
Figure 3B:
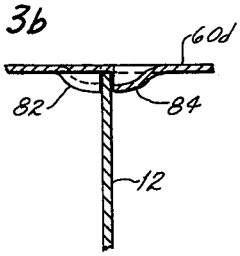
FIG. 3B is a cross-sectional view of a portion of the fan assembly box taken along lines 3—3 of FIG. 2 with the orifice pan in place.

Reference may be made to FIGS. 3A, 3B and 4 which show the detents 82 and 84 in greater detail. FIG. 4 is a view of a portion of the top wall 60d of fan housing box 14 and shows detents 82 and 84 as they are punched or formed into the interior of the box 14. Along each edge 86 and 87 of detents 82 and 84, the metal of top wall 60d is severed and the remaining portion of the detents form a depression in top wall 60d. Edges 86 and 87 are formed along lines which are spaced from each other approximately a distance slightly greater than the thickness of orifice pan 12. The cross-sectional view shown in FIGS. 3A and 3B show the detents in their operative positions. FIG. 3A shows the detents depending from top wall 60d of fan housing box 14 without orifice pan 12 and FIG. 3B shows the same detents with orifice pan 12 captured therebetween. It is obvious that the other two detents 78 and 80 are aligned with detents 84 and 82 respectively to form a straight line for the retention of orifice pan 12. Detents 80 and 82 keep pan 12 from coming out of box 14 and detents 78 and 84 keep it from being driven down too far into box 14.

Figure 2:
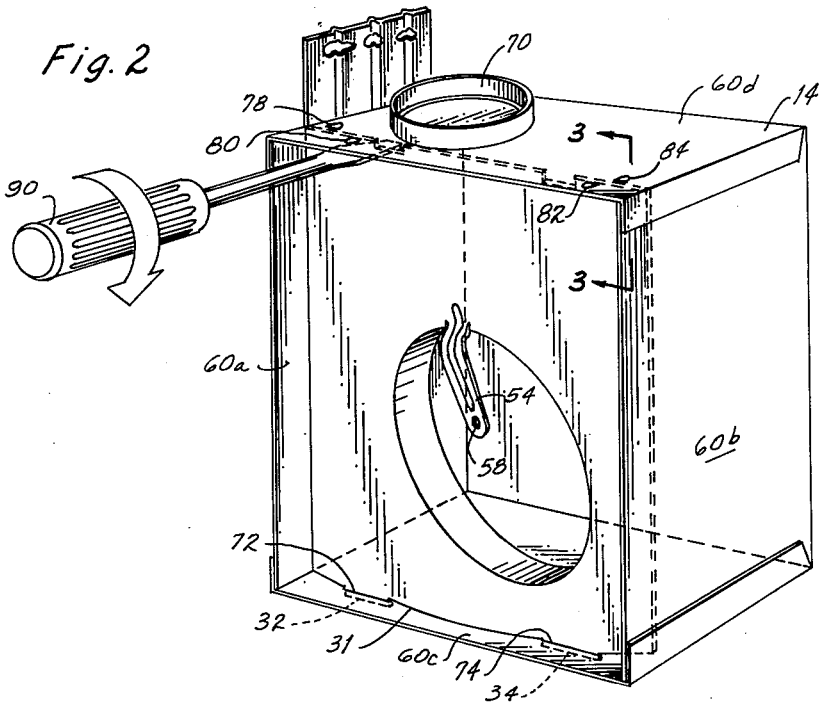
FIG. 2 is a perspective view of the fan assembly box of the invention with a phantom rendition of a means to disassemble a closure for the box.

FIG. 2 shows the installation of orifice pan 12 into force fitting engagement with fan housing box 14. The vertical distance between top wall 60d and bottom wall 60c is of a predetermined length. The vertical length of orifice pan 12 from lower edge 31 to upper edge 36 is made slightly greater than the predetermined vertical distance between bottom wall 60c and top wall 60d of fan housing box 14. The greater length may be only in the order of a few thousandths of an inch but sufficient so that, to insert orifice pan 12 into engagement with fan housing box 14, the top wall of box 14 may be pried upwardly either by a tool such as a screwdriver 90 or by forcing the upper edge 36 of orifice pan 12 over detents 80 and 82.

For clarity and ease of explanation, fan 62 and baffle 64 have been omitted from FIG. 2.

In the installation of the fan housing assembly of FIG. 1 fan housing box 14 is nailed or otherwise secured to building framing members in the well-known manner with an outlet conduit attached to valve outlet 70 to vent vapors and gases to the outside of a building. Suitable electrical wiring and switches are provided to fan 62. Orifice pan 12 is fixed into fan housing box 14 by inserting outwardly extending fingers 32 and 34 of orifice pan 12 into slots 72 and 74 of fan housing box 14. Using the engaged fingers and slots as pivotal points, orifice pan 12 is then rotated clockwise upwardly until its upper surface 36 touches outer detents 80 and 82 in the top wall 60d of fan housing 14. By using a screwdriver 90 (FIG. 2) or by pushing the top edge of pan 12 over detents 80 and 82 into engagement with inner detents 78 and 84, orifice pan 12 is securely locked in vibration-proof engagement with fan housing box 14. Ventilating grille 10 is then secured to supporting member 54 by means of a fastener or screw 26. The complete assembly is ready for venting gases from a confined area.

To clean the fan assembly or service fan 62, it is merely necessary to remove ventilating grille 10 by removing screw 26. Then by inserting the blade of a screwdriver 90 into each slot 50 and 52 along the upper edge 36 of orifice pan 12 and rotating the screwdriver blade about 45°, the top wall 60d of fan housing 14 is raised enough to disengage the top edge 36 of orifice pan 12 from its engagement with detents 78–80 and 82–84. Orifice pan 12 is then rotated outwardly from the front of fan housing box 14 and removed to provide complete access to the interior of fan housing box 14.

Reassembly is as previously described.

In summary, there is presented a fan housing assembly which has an orifice pan frictionally engaged in a fan housing box and capable of easy removal for access to the interior of the fan housing box.

I claim:

1. In a fan housing assembly comprising a generally rectangular hollow box having an open side, a bottom wall and a top wall, said open side having a predetermined vertical open dimension, an exhaust fan mounted inside said hollow box, baffle means mounted in said hollow box, said baffle means partially surrounding said fan, outlet means penetrating a wall said box so that air may be exhausted from said box, an orifice pan arranged to partially close said open side to restrict air flow into said hollow box, said orifice pan having a circular opening in alignment with said exhaust fan, and a ventilating grille attachable to said orifice pan to form a closure for said open side, the improvement in which said orifice pan has outwardly extending fingers spaced apart with respect to each other along one edge thereof, the edge of said orifice pan opposite said one edge being spaced from said one edge a distance greater than said predetermined vertical open dimension of said open side, said bottom wall of said box having slots therein spaced apart a distance equal to the distance between said fingers and being adapted to receive said fingers, and top wall of said box having pairs of inwardly extending detents adapted to receive said opposite edge of said orifice pan, said opposite edge of said orifice pan further having cut out portions located so that when said orifice pan is in its engaged position, a tool can be inserted therein to disengage said orifice pan from said fan housing box, whereby said orifice pan can be easily removed from said open side of said hollow box to permit easy entry for servicing and cleaning said fan.

2. In a fan housing assembly as recited in claim 1 in which said orifice pan lies in a flat plane and has a member integrally attached thereto, said member having a portion thereof extending in a plane parallel to the plane of said pan and over a portion of said circular opening, said integral member further having an internally threaded hole adapted to receive a removable fastener which fastener is adapted to secure said ventilating grille to said pan.

3. In a housing assembly as recited in claim 1 in which said edge of said orifice pan containing said fingers has an arcuate shape.

4. In a housing assembly as recited in claim 1 in which each one of said detents of each pair of detents is spaced from one another by a distance substantially equal to the thickness of said orifice pan.

* * * * *